United States Patent [19]

Imoehl

[11] Patent Number: 4,850,319

[45] Date of Patent: Jul. 25, 1989

[54] ELECTRONIC THROTTLE ACTUATOR

[75] Inventor: William J. Imoehl, Williamsburg, Va.

[73] Assignee: Siemens-Bendix Automotive Electronics L.P., Troy, Mich.

[21] Appl. No.: 157,769

[22] Filed: Feb. 18, 1988

[51] Int. Cl.[4] ..... F02D 41/00

[52] U.S. Cl. ..... 123/361; 251/129.11; 261/65

[58] Field of Search ..... 123/361, 399; 261/65; 464/137; 403/335, 336; 74/513, 514; 251/129.08, 129.11, 129.12

[56] References Cited

U.S. PATENT DOCUMENTS

| | | | |
|---|---|---|---|
| 1,598,716 | 9/1926 | Greuter | 261/65 X |
| 2,148,975 | 2/1939 | Agren | 464/137 X |
| 2,412,021 | 12/1946 | Weakley | 261/65 |
| 4,086,896 | 5/1978 | Hicks et al. | 261/65 X |
| 4,541,378 | 9/1985 | Kitamura | 123/399 X |
| 4,582,653 | 4/1986 | Blanchard et al. | 74/513 X |
| 4,601,271 | 7/1986 | Ejiri et al. | 123/361 |
| 4,747,380 | 5/1988 | Ejiri et al. | 123/399 |

FOREIGN PATENT DOCUMENTS

| | | | |
|---|---|---|---|
| 55-40224 | 3/1980 | Japan | 123/647 |
| 60-204930 | 10/1985 | Japan . | |

*Primary Examiner*—Noah P. Kamen

*Attorney, Agent, or Firm*—Russel C. Wells; George L. Boller

[57] ABSTRACT

An electronic throttle actuator is directly connected without an intervening gear train to a stepper motor for rotating the throttle valve from a first position, closed or substantially closed, to a second position which is wide open and any angular position therebetween. The movement of the throttle valve is under control of electronic control means which can locate the throttle valve at any one of a plurality of positions between the first and the second positions. The coupling between the motor and the shaft of the throttle valve provides for redundant means to close the throttle valve and connected to the shaft are a pair of redundant torsion springs for biasing the throttle valve in said first position. A second coupling directly connects the shaft of the throttle valve to a throttle position sensor. A pair of cavities are formed in the throttle body housing for enclosing both the coupling from the shaft to the motor and to the throttle position sensor and the redundant torsion springs. Vent passages communicate the cavities to the throttle bore.

7 Claims, 2 Drawing Sheets

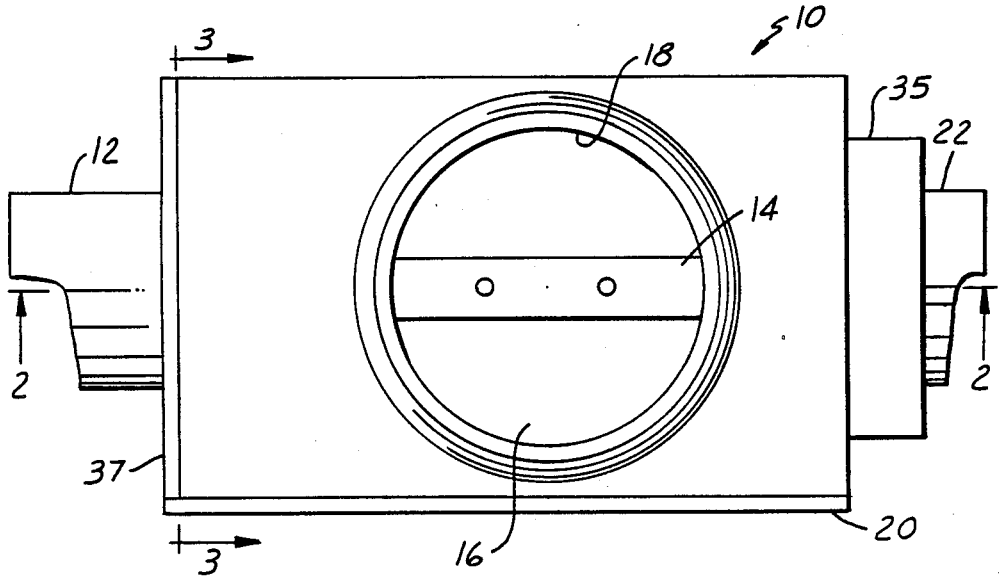
FIG. 1
FIG. 2
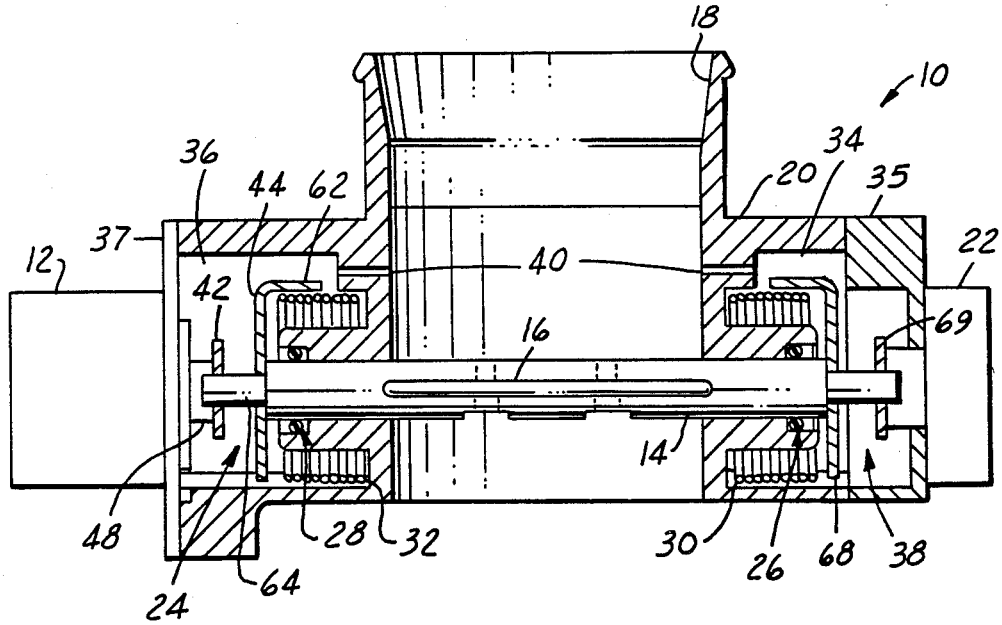

ELECTRONIC THROTTLE ACTUATOR

This invention relates to electronic control systems for internal combustion engines in general and more particularly to electrically actuated throttle body assemblies.

BACKGROUND OF THE INVENTION

Conventional control of a throttle in an internal combustion engine involves a series of links and linkages from a foot pedal in the passenger compartment of a motor vehicle to the butterfly valve or throttle blade in the air intake of the engine. Each link and pivot position provides a source for misadjustment and failure. Failure because of corrosion and dirt between the pivot surfaces and misadjustment because of wear and looseness in the connection of the links.

SUMMARY OF THE INVENTION

Drive-by-wire or electronic throttle control is a concept where the motion of the foot pedal or throttle control in the operator compartment of the vehicle is transferred by electrical signals to an actuator for moving the butterfly valve. The actuator in most instances is a d.c. motor which rotates through a system of gears the throttle blade from a substantially closed throttle position to a wide open throttle position. Positioning is determined in a servo controlled manner.

The main advantage of this electronic throttle actuator is a mechanical system using a stepper motor directly coupled to the throttle blade shaft without any intervening gears which may wear or break.

Another advantage of the present system is an electronic gear reduction unit which is capable of converting 1.8° of throttle movement into 0.056° steps.

Other advantages will become apparent from the electronic throttle actuator for an internal combustion engine having a throttle body housing with a throttle bore extending therethrough. A shaft means is mounted for rotation and extends through the throttle bore from one wall to the diametrically opposed wall. A throttle blade is mounted on the shaft means and is rotatable therewith from a substantially closed position to a substantially wide open position depending upon the system design specifications. At least one torsion spring biases the shaft means in a rotatable direction to position the throttle blade in the substantially closed position. A cavity means is formed in the housing for enclosing the torsion spring. A motor is mounted on the throttle body housing and is directly coupled without any intervening gear reduction means to the shaft means. Electronic control means is operatively connected for operating the motor to rotate the shaft means and hence the butterfly valve to control the flow air into the engine.

Many other advantages and purposes of the invention will be clear from the following detailed description of the drawings.

DETAILED DESCRIPTION OF THE DRAWINGS

In the drawings:

FIG. 1 is top view of the electronic throttle actuator.

FIG. 2 is a sectional view taken along line 2—2 of FIG. 1.

DETAILED DESCRIPTION

Figure 3:
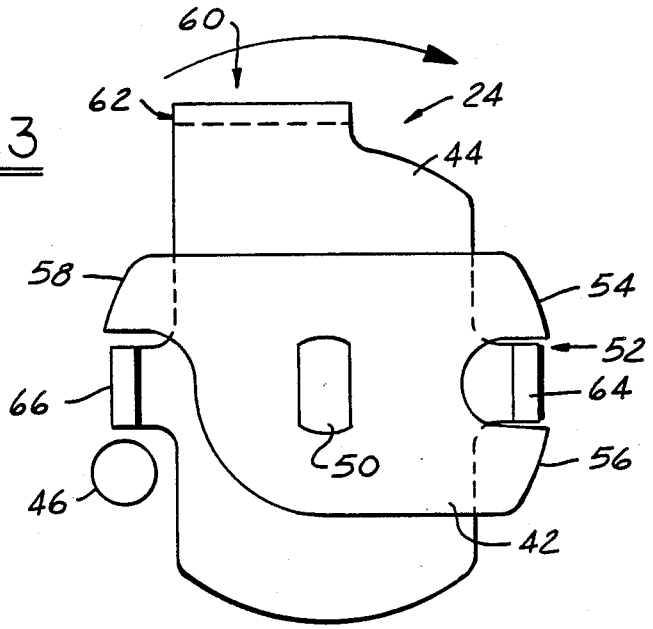
FIG. 3 is a sectional view taken along line 3—3 of FIG. 1.

Referring to FIG. 1 there is shown a top view of an electronic throttle actuator 10 according to the preferred embodiment. The butterfly 10 has a motor 12 connected to the shaft 14 of the throttle blade or butterfly valve 16. The butterfly valve 16 is located in the air intake or throttle bore 18 in the throttle body housing 20. In order to provide positioning readout of the butterfly valve 16, a throttle position sensor 22 is located at the end of the shaft 14 of the throttle blade 16 opposite the motor 12.

As will be described, it will be obvious that the only changes necessary to adapt the preferred embodiment for different engines is to change the various sizes of the components to accomodate the various throttle bore diameters 18 and mounting holes. The motor 12 and the throttle position sensor 22 are adequate for most all engine sizes.

FIG. 2 is a sectional view taken along line 2—2 of FIG. 1 which is essentially along the axis of the butterfly valve shaft 14. The throttle body housing 20 has the air intake bore 18 which is adapted to receive an air cleaner means, not shown, at one end and to discharge the air intake into the intake manifold, not shown, at the other end. If desired, an air flow sensor maybe connected in line with the air intake bore 18.

The motor 12, which is a d.c. stepper motor, is directly coupled to the throttle blade shaft 14 through a coupling assembly 24 illustrated in FIG. 3. The throttle blade shaft 14 is mounted for rotation in a pair of axially disposed seals 26, 28. The function of the seals 26, 28 is to keep dirt and corrosion from the bearing surfaces of the shaft 14. Secured to the shaft 14 by conventional means is the plate of the butterfly valve 16.

At least one torsion or return spring 30 or 32 is secured to the shaft 14 for biasing the shaft in a closed or substantially closed position. In the preferred embodiment there are a pair of return springs 30, 32 secured to each end of the shaft 14 and that operate to bias the butterfly valve 16 to a closed position or substantially closed position. If the power is removed from the motor 12, or there is a fracture in any of the components of the throttle actuator 10, the torsion or return springs 30, 32 will cause the shaft 14 to rotate, closng the butterfly valve 16 to an idle speed or closed position. The return springs 30, 32 provide a failsafe redundancy to the actuator 10 in that either spring 30, 32 has sufficient torsional forces to rotate the shaft 14.

The throttle body 20 has a pair of cavities 34, 36, a sensor cavity 34 and a motor cavity 36, positioned at each end of the shaft 14 for housing the springs 30, 32 and the coupling assemblies 24, 38. The purpose of the cavities 34, 36 is keep the area clean from any external contaminants such as dirt, water, screwdrivers, etc. which may operate to cause failure of the actuator 10. A plate means 35, 37 attached to the housing 20 by conventional means, not shown, encloses the cavities 34, 36. In addition, each of the cavities 34, 36 has a vent 40 to the air flowing through the throttle bore 18 which air has already passed through the engine air cleaner. The air flowing through the vents operates to prevent contaminants from entering into the cavities 34, 36 through pressure differentials caused by leaks in the butterfly valve shaft seals 26, 28, temperature cycling of air trapped in the cavities 34, 36, the throttle position sensor 22 or the motor 12.

In order to minimize the torque needed to open the butterfly valve 16, the shaft 14 is slightly offset from the center of the throttle bore 18. This offset which is from zero to ten thousandths of an inch (0.0254 mm) operates to bias the butterfly valve 16 to close reliably in the event of motor 12 failure, etc. wherein the torsion springs 30, 32 supply the closing torque necessary to rotate the shaft 14.

Referring to FIG. 3 there is illustrated the coupling assembly 24 between the motor 12 and the shaft 14. A substantially similar coupling assembly 38 may be used between the shaft 14 and the throttle position sensor 22. The purpose of the coupling assemblies 24, 38 is to ensure direct drive of the shaft 14 from the motor 12 and from the shaft 14 to the throttle position sensor 22 respectively. The coupling assembly 24 comprises a motor face plate 42, a shaft face plate 44 and a limit pin 46.

The motor face plate 42 is directly connected to the motor shaft 48 by conventional means such as a slotted aperture 50. In the illustration of FIG. 3, the motor face plate 42 is generally of an oblong shape wherein at one end there is a "U" shaped opening 52. One side of the "U" shaped opening 52 is an open drive lever 54 and the other side is a close drive lever 56. The nomenclature of open and close refers to the positioning of the butterfly valve 16. The other end of the oblong shape has a redundant close drive lever 58.

The shaft face plate 44 is similarly an oblong shape wherein at one end 60 of the long dimension, there is an extension 62 which receives one end of the return spring 32 in the motor cavity 36. The shaft face plate 44 is likewise secured to the butterfly valve shaft 14 by conventional means such as slotted aperture. Along the narrow sides of the shaft face plate 44 are a pair of tangs 64, 66 formed in a direction toward the motor face plate 42 when the coupling is assembled. One of the tangs 64 is positioned in the opening of the "U" shaped aperture 52 in the motor face plate 42. The open drive lever 54 operates to bear against this tang 64 to rotate the shaft 14 in the clockwise direction. The diametrically opposite tang 66 is positioned to bear against the redundant close drive lever 58 to close the throttle butterfly valve under the urging of the springs 30 and 32. The limit pin 46 is used to prevent opening of the throttle butterfly valve with the close drive lever 56 against the tang 66 when the open drive lever 54 of the tang 64 has failed. Note in the preferred embodiment, there are redundant closing drive levers 56, 58, but only one open drive lever 54 to provide a failsafe operation closing the throttle valve 16.

Located in the sensor cavity 34 is the second coupling assembly 38. Secured to the shaft 14 by conventional means such as a slotted aperture or by means of pinning is a second shaft face plate 68. The function of this second shaft face plate 68 is to provide a drive connection for the return spring 30 located in the sensor cavity 34. The end of the shaft 14 is configured to mate through the sensor face plate 69 with the throttle position sensor 22. Such a throttle position sensor may be that described in U.S. Pat. No. 4,355,293 issued on Oct. 19, 1982 to Barry J. Driscoll and entitled "Electrical Resistance Apparatus Having Integral Shorting Protection" which is assigned to a common assignee and is incorporated herein by reference.

Figure 4:
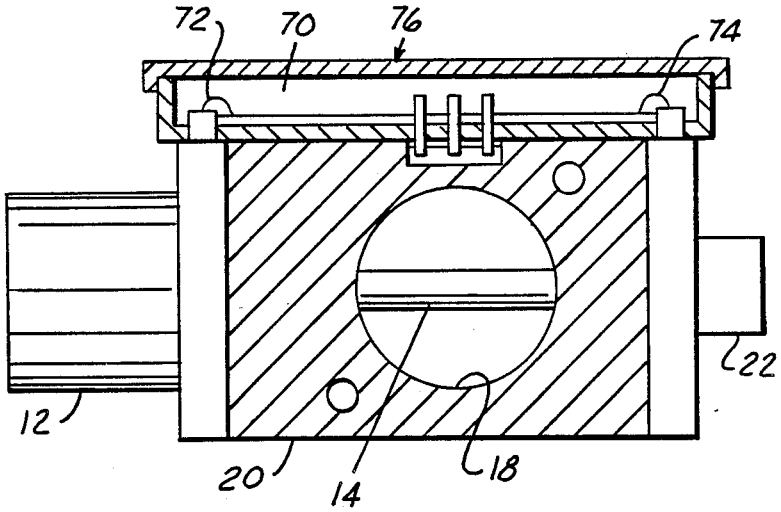
FIG. 4 is a top view of another embodiment of the electronic throttle actuator showing the electronic control package mounted thereon.

As this is an electronic throttle actuator, the necessary electronics 70 as described in copending application by Wright et.al. entitled "Microstepping of an Unipolar D.C. Motor" which is incorporated herein by reference may be packaged and placed on the side of the throttle body housing 20 as illustrated in FIG. 4. In this manner, the leads 72 from the motor 12 and the leads 74 from the throttle position sensor 22 may be contained within the electronics housing 76 and not exposed. The power electronics may be positioned so as to have the heat generated thereby transferred to the air flow through the throttle bore 18. As illustrated in FIG. 4, this positions the power electronics along the thinnest wall of the throttle bore 18. A connector, not shown, is used to provide power and control signals to the electronics 70 for operating the electronic throttle actuator.

The combination of the electronics 70 as described in the copending application and the design of the coupling 24 between the motor 12 and the butterfly valve 16 provides a means to release a butterfly valve which has been frozen or iced closed in the throttle bore 18. The synchronization of the motor and the throttle position sensor 22 causes the stepping motor to oscillate until the ice has been dislodged and the butterfly valve is freed.

Many changes and modifications in the above described embodiment of the invention can, of course, be carried out without departing from the scope thereof. Accordingly, that scope is intended to be limited only by the scope of the appended claims.

I claim:

1. An electronic throttle actuator for an internal combustion engine comprising:

a throttle body housing;

a throttle body in said housing and extending therethrough;

shaft means mounted for rotation and extending through said throttle bore from one wall to the diametrically opposed wall;

a throttle blade mounted on said shaft means and rotatable therewith from a substantially closed position to a substantially wide open position;

a torsion spring biasing said shaft means in a rotatable direction to position said throttle blade in said substantially closed position;

cavity means in said housing for receiving one end of said shaft means and enclosing said torsion spring;

motor means mounted on said throttle body housing;

coupling means for gearlessly coupling said motor means to said shaft means;

electronic control means for operating said motor means to rotate said shaft means, additionally includes a throttle position sensor means operatively coupled to said shaft means for indicating the angular position of said throttle blade, additionally including a second cavity means in said housing for receiving the other end of said shaft means, and additionally including coupling means located in said second cavity means for directly coupling said shaft means to said throttle position sensor means.

2. An electronic throttle actuator for an internal combustion engine according to claim 1 wherein said coupling means for directly coupling said shaft means to said throttle position sensor means comprises:

a sensor face plae means connected to said throttle position sensor means, a shaft face plate means connected to one end of said shaft means, and means interconnecting said sensor face plate means and said shaft face plate means.

3. An electronic throttle actuator for an internal combustion engine comprising:

a throttle body housing;

a throttle bore in said housing and extending therethrough;

shaft means mounted for rotation and extending through said throttle bore from one wall to the diametrically opposed wall;

a throttle blade mounted on said shaft means and rotatable therewith from a substantially closed position to a substantially wide open position;

a torsion spring biasing said shaft means in a rotatable direction to position said throttle blade in said substantially closed position;

cavity means in said housing for receiving one end of said shaft means and enclosing said torsion spring;

motor means mounted on said throttle body housing;

coupling means for gearlessly coupling said motor means to said shaft means;

electronic control means for operating said motor means to rotate said shaft means, and said electronic throttle actuator additionally having vent means extending from said throttle bore to said cavity means.

4. An electronic throttle actuator for an internal combustion engine comprising:

a throttle body housing;

a throttle bore in said housing and extending therethrough;

shaft means mounted for rotation and extending through said throttle bore from one wall to the diametrically opposed wall;

a throttle blade mounted on said shaft means and rotatable therewith from a substantially closed position to a substantially wide open position;

a torsion spring biasing said shaft means in a rotatable direction to position said throttle blade in said substantially closed position;

cavity means in said housing for receiving one end of said shaft means and enclosing said torsion spring;

motor means mounted on said throttle body housing;

coupling means for gearlessly coupling said motor means to said shaft means;

electronic control means for operating said motor means to rotate said shaft means, and wherein said means for gearlessly coupling said motor means to shaft means comprises:

a motor face plate means connected to the shaft of said motor means, a shaft face plate means connected to one end of said shaft means, and means interconnecting said motor face plate means and said shaft face plate means; and wherein said means interconnecting said motor face plate means and said shaft face plate means comprises:

a pair of diametrically opposed tangs extending from said shaft face plate means;

a "U" shaped slot in said motor face plate means for receiving one of said tangs; and a lever on said motor face plate means operable to engage the other of said tangs.

5. A coupling for directly coupling a drive and a driven shaft providing redundant drive in one rotational direction and single drive in the other rotational direction, said coupling comprising:

a drive shaft face plate means connected to the drive shaft, a driven shaft face plate means connected to one end of the driven shaft, a pair of diametrically opposed tangs extending from said driven shaft face plate means;

a "U" shaped slot in said drive face plate means for receiving one of said tangs, one side of said "U" shaped slot for rotating said tang in one rotational direction and the other side of said "U" shaped slot for rotating said tang in the other rotational direction; and a lever on said drive face plate means operable to engage the other of said tangs for rotating said other of said tangs in only one direction.

6. An electronic throttle actuator for an internal combustion engine comprising in combination:

a throttle body housing;

a throttle bore in said housing and extending therethrough;

throttle valve means disposed in said throttle bore;

journal means for journalling said throttle valve means on said throttle body for rotatable motion about an axis that is transverse to said throttle bore, said journal means including a shaft means that supports said throttle valve means and that passes through and beyond respective holes in said throttle body housing on opposite sides of said throttle bore;

first closure means cooperating with said throttle body housing in forming a first cavity containing that portion of sadi shaft means which has passed beyond a first of said holes;

second closure means cooperating with said throttle body housing in forming a second cavity containing that portion of said shaft means which has passed beyond a second of said holes;

said first and second closure means respectively including a motor means and a throttle position sensor means respectively;

first coupling means disposed within said first cavity for operatively coupling said motor means with said shaft means so that operation of said motor means is effective to position said throttle valve means about said axis;

and second coupling means disposed within said second cavity for operatively coupling said shaft means with said throttle position sensor means so that said throttle position sensor means is effective to provide a signal indicative of the position of said throttle valve means about said axis.

7. In an electronic throttle actuator for an internal combustion engine, the combination comprising:

a throttle body housing;

a throttle bore in said housing and extending therethrough;

throttle valve means disposed in said throttle bore;

journal means for journaling said throttle valve means on said throttle body for rotation motion about an axis that is transverse to said throttle bore;

said journal means including a shaft that supports said throttle valve means and that passes through and beyond a hole in said throttle body housing;

closure means cooperating with said throttle body housing in forming a cavity containing that portion of said shaft which has passed beyond said hole, said closure means including an electromechanical device that is associated with the electronic throttle actuator;

coupling means disposed within said cavity operatively coupling said electromechanical device with said shaft so that said electromechanical device and said shaft operate in unison;

and vent passage means that is separate from said hole and communicates said cavity to said throttle bore.

* * * * *